US012692561B2

(12) United States Patent
Xiao et al.

(10) Patent No.: US 12,692,561 B2
(45) Date of Patent: Jul. 28, 2026

(54) BLAST FURNACE—CONVERTER STEEL PRODUCTION METHOD BASED ON CARBON CYCLING

(71) Applicant: CISDI Engineering Co., Ltd., Chongquing (CN)

(72) Inventors: Xuewen Xiao, Chongqing (CN); Zhongping Zou, Chongqing (CN); Gang Wang, Chongqing (CN); Yunjian Zhao, Chongqing (CN); Qun Niu, Chongqing (CN); Shifeng Hou, Chongqing (CN); Jun Xu, Chongqing (CN); Zhibin Hong, Chongqing (CN); Muming Li, Chongqing (CN); Meng Long, Chongqing (CN)

(73) Assignee: CISDI Engineering Co., Ltd., Chongquing (CN)

( * ) Notice: Subject to any disclaimer, the term of this patent is extended or adjusted under 35 U.S.C. 154(b) by 229 days.

(21) Appl. No.: 18/689,073

(22) PCT Filed: Mar. 8, 2022

(86) PCT No.: PCT/CN2022/079651
§ 371 (c)(1),
(2) Date: Mar. 5, 2024

(87) PCT Pub. No.: WO2023/019917
PCT Pub. Date: Feb. 23, 2023

(65) Prior Publication Data

US 2026/0043097 A1 Feb. 12, 2026

(30) Foreign Application Priority Data

Aug. 19, 2021 (CN) ..... 202110955413.5

(51) Int. Cl.
*C21B 5/00* (2006.01)
*C21C 5/38* (2006.01)

(52) U.S. Cl.
CPC ..... *C21B 5/001* (2013.01); *C21C 5/38* (2013.01); *C21B 2005/005* (2013.01); *C21C 2100/02* (2013.01); *C21C 2100/04* (2013.01)

(58) Field of Classification Search
CPC ..... Y02P 10/122
See application file for complete search history.

(56) References Cited

FOREIGN PATENT DOCUMENTS

| | | |
|---|---|---|
| CN | 102643937 A | 8/2012 |
| CN | 109351144 A | 2/2019 |
| CN | 212375235 U | 1/2021 |

OTHER PUBLICATIONS

NPL: on-line translation of CN102643937A, Aug. 2012 (Year: 2012).*

(Continued)

*Primary Examiner* — Jie Yang
(74) *Attorney, Agent, or Firm* — Wang Law Firm, Inc.

(57) ABSTRACT

The present invention pertains to the field of steel smelting, specifically to a method for steel production in a blast furnace and a converter based on carbon cycling. The method comprises the following steps:

1. Smelting iron in a blast furnace to obtain molten iron;
2. Introducing the aforementioned molten iron into a converter and carrying out steel refining within the converter to obtain molten steel and untreated converter gas;
3. Subjecting the untreated converter gas to pressurisation, deoxygenation, dehydration, and decarbonisation treatments to obtain synthesis gas and treated converter gas;
4. Recycling the treated converter gas back into the blast furnace to regulate the ratio of reductive gases within the furnace atmosphere.

(Continued)

Beneficial Effects: The method enables the cyclic utilisation of converter gas. By decarbonising the converter gas and recycling it back into the blast furnace, the content of reductive gases in the furnace atmosphere is enhanced. This promotes indirect reduction within the blast furnace while decreasing direct reduction, thereby reducing the consumption of carbonaceous fuel during the blast furnace iron smelting process and effectively lowering CO2 emissions.

5 Claims, 5 Drawing Sheets

(56) References Cited

OTHER PUBLICATIONS

NPL: on-line translation of CN109351144A, Feb. 2019 (Year: 2019).*
First Office Action of corresponding CN application 202110955413.5, published on Jan. 20, 2022.
Office Action prior to grant of corresponding CN application 202110955413.5, published on Mar. 22, 2022.
Notice of Grant of Patent Right of corresponding CN Application 202110955413.5, published on May 24, 2022.
Claims of corresponding CN application 202110955413.5.

* cited by examiner

BLAST FURNACE—CONVERTER STEEL PRODUCTION METHOD BASED ON CARBON CYCLING

TECHNICAL FIELD

The present invention relates to the field of steel smelting, particularly to a method of steel production based on a carbon cycle in a blast furnace-electric arc furnace.

BACKGROUND TECHNOLOGY

Green and low-carbon development is the main theme of today's global steel industry. Iron smelting is the primary carbon-emitting process in the steel industry, accounting for 85% of the entire process. For the foreseeable future, the global industry will continue to rely on the blast furnace-electric arc furnace production process. Therefore, achieving breakthroughs in green, low-carbon smelting technology is crucial for supporting the steel industry's low-carbon development and meeting carbon peak and carbon neutrality goals. Particularly in energy and resource-intensive industries like steel production, a significant amount of secondary energy and by-products are generated. Currently, the recycling rate of these secondary resources is quite low. Improving the utilisation efficiency of secondary energy in steel production is essential and holds significant potential for reducing energy consumption and CO2 emissions. At present, the yield of electric arc furnace gas is 80-120 $m^3$ per tonne of steel. However, its primary utilisation within steel plants is still for heating by combustion, which is not only inefficient but also results in significant CO2 emissions, conflicting with green, low-carbon development goals.

SUMMARY OF THE INVENTION

In light of the drawbacks of existing technology, the objective of this invention is to provide a blast furnace-electric arc furnace steel production method based on carbon cycling, aimed at solving the problem of high CO2 emissions in the current steel production process. To achieve the aforementioned objective and other related objectives, the present invention provides a method including the following steps:

1. Iron smelting in a blast furnace to obtain molten iron;
2. Introducing the molten iron into an electric arc furnace for steelmaking, obtaining molten steel and untreated electric arc furnace gas;
3. Subjecting the untreated electric arc furnace gas to pressurisation, deoxygenation, dehydration, and decarbonisation to obtain syngas and treated electric arc furnace gas;
4. Recycling the treated electric arc furnace gas back into the blast furnace to regulate the ratio of reducing gases in the furnace belly.

Optionally, the untreated coke oven gas is subjected to pressurisation, deoxygenation, dehydration, and decarbonisation to obtain a synthetic gas and treated coke oven gas, including:

Pressurising the untreated coke oven gas to 0.50 MPa~0.65 MPa using a gas pressurisation unit to obtain pressurised coke oven gas;

Deoxygenating the pressurised coke oven gas to an oxygen content of less than 1 ppm via a gas deoxygenation unit to obtain deoxygenated coke oven gas;

Dehydrating the deoxygenated coke oven gas until a dehydration efficiency of greater than 95% is achieved via a gas dehydration unit to obtain dehydrated coke oven gas;

Decarbonising the dehydrated coke oven gas until a CO2 removal rate of greater than or equal to 95% is achieved via a gas decarbonisation unit to obtain decarbonised coke oven gas.

Optionally, the CO content in the untreated coke oven gas is greater than or equal to 40%.

Optionally, in addition to pressurisation, deoxygenation, dehydration, and decarbonisation, the untreated coke oven gas undergoes desulphurisation and denitrification treatments, wherein desulphurisation precedes denitrification.

Optionally, desulphurising the pressurised coke oven gas to a sulphur content of less than 10 ppm to obtain desulphurised coke oven gas, and denitrifying the decarbonised coke oven gas until a denitrification efficiency of greater than or equal to 90% is achieved to obtain denitrified coke oven gas.

Optionally, prior to the desulphurisation treatment, controlling the temperature of the pressurised coke oven gas to 60° C.~90° C. via a cooling unit.

Optionally, the pressurisation, desulphurisation, deoxygenation, dehydration, decarbonisation, and denitrification treatments are performed sequentially.

Optionally, the treated coke oven gas is recirculated back into the blast furnace to adjust the ratio of reductive gases in the blast furnace gas, including:

Heating the treated coke oven gas to 850° C.~950° C. via a gas heating unit to obtain heated coke oven gas;

Circulating the heated coke oven gas back into the blast furnace via a gas injection unit, wherein the injection nozzle of the gas injection unit is aimed at the body and/or tuyeres of the blast furnace.

Optionally, the heat required for the gas heating unit is provided by burning the gas in the gas network, which includes blast furnace gas and/or synthetic gas.

Optionally, the decarbonisation process can be either dry or wet; when dry decarbonisation is used, the CO2 concentration in the synthetic gas is less than or equal to 95%, and the synthetic gas is fed into the gas network connected to the blast furnace; when wet decarbonisation is used, the CO2 concentration in the synthetic gas is greater than 95%, and the synthetic gas undergoes CCUS treatment.

The carbon-cycling-based method for steel production via a blast furnace and coke oven has at least the following benefits: it enables the recycling of coke oven gas, reducing the consumption of carbonaceous fuel in the ironmaking process of the blast furnace, effectively reducing CO2 emissions.

DESCRIPTION OF COMPONENT LABELS

Figure 1:
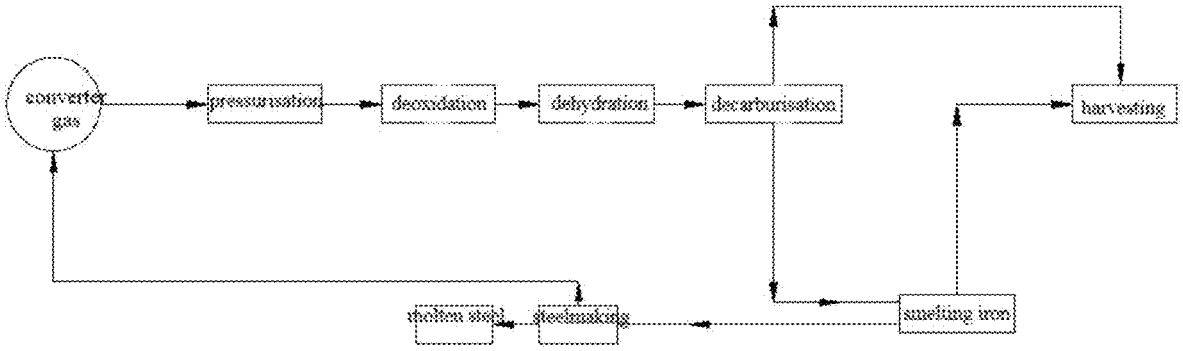
FIG. 1 is a schematic flow diagram of Embodiment 1 of the carbon-cycling-based method for steel production via a blast furnace and coke oven, as provided by this application.

1—Blast Furnace; 11—Furnace Body; 12—Tuyere; 2—Converter; 3—Gas Injection Device; 4—Converter Gas Collection Device; 51—Gas Compression Device; 52—Gas Desulphurisation Device; 53—Gas Deoxygenation Device; 54—Gas Dehydration Device; 55—Gas Decarbonisation Device; 56—Gas Denitrification Device; 6—Gas Heating Device; 7—Gas Pipeline Network; 8—CCUS (Carbon Capture, Utilisation, and Storage) Device; 9—Molten Steel.

DETAILED IMPLEMENTATION METHOD

The present invention is elaborated through specific examples to illustrate its embodiments. Skilled persons in this field can easily understand other advantages and effects of the present invention from the content disclosed in this specification. The present invention can also be implemented or applied through other different specific embodiments, and various details in this specification can also be modified or altered based on different viewpoints and applications without departing from the spirit of the invention.

Please refer to FIGS. 1 to 6. It should be noted that the diagrams provided in this example are merely illustrative of the basic concept of the invention; therefore, the diagrams only show components related to this invention and are not drawn according to the actual number, shape, and size of components during implementation. The form, quantity, and proportion of each component in actual implementation can be arbitrarily altered, and the layout of components may also be more complex. The structures, proportions, and sizes shown in the attached figures of this specification are only to complement the content disclosed, for understanding and reading by those skilled in this technology, and do not technically limit the conditions under which the invention can be implemented.

Before detailing the embodiments of this invention, a description of the application environment of the invention is provided. The technology of this invention is mainly applied to steel smelting, particularly applied to the carbon cycle in the blast furnace-basic oxygen furnace steel production process. The invention aims to solve the problem of high carbon dioxide emissions in traditional steel production processes.

Refer to FIGS. 1 to 10. In some embodiments, this application provides a carbon-cycle-based blast furnace-basic oxygen furnace steel production method, which includes the following steps:

1. Smelting iron in blast furnace 1 to obtain molten iron.
2. Introducing the molten iron into basic oxygen furnace 2, where steel is produced, yielding molten steel and untreated basic oxygen furnace gas.
3. Subjecting the untreated basic oxygen furnace gas to pressurisation, deoxygenation, dehydration, and decarbonisation, to obtain syngas and treated basic oxygen furnace gas.
4. Recycling the treated basic oxygen furnace gas by injecting it back into blast furnace 1 to regulate the proportion of reducing gas in the blast furnace gas.

Furthermore, the steps of pressurisation, deoxygenation, dehydration, and decarbonisation are performed in sequence.

Optionally, blast furnace 1 is connected to basic oxygen furnace 2, and the basic oxygen furnace gas produced during the steel-making process can be collected and stored through a basic oxygen furnace gas collection device 4.

Furthermore, the basic oxygen furnace gas collection device 4 can be a basic oxygen furnace gas cabinet or a basic oxygen furnace gas user network.

The aforementioned carbon-cycle-based blast furnace-basic oxygen furnace steel production method, through simple steps, utilises the basic oxygen furnace gas produced in the steel-making process. After the basic oxygen furnace gas undergoes pressurisation, deoxygenation, dehydration, and decarbonisation, it is recycled and injected back into the blast furnace for iron smelting. This fully utilises the effective reducing gases in the basic oxygen furnace gas, improves the proportion of reducing gas in the blast furnace gas, promotes indirect in reduction in the blast furnace, reduces the consumption of carbonaceous fuel in blast furnace iron smelting, and effectively lowers CO2 emissions in the blast furnace-basic oxygen furnace steel production system.

With reference to FIGS. 1 to 10, in some embodiments, the untreated converter gas undergoes pressurisation, deoxygenation, dehydration, and decarbonisation to obtain syngas and treated converter gas, including:

Pressurising the untreated converter gas to 0.50 MPa~0.65 MPa through a gas pressurisation unit 51 to obtain pressurised converter gas;

Deoxygenating the pressurised converter gas to an oxygen content less than 1 ppm through a gas deoxygenation unit 53 to obtain deoxygenated converter gas;

Dehydrating the deoxygenated converter gas to a dehydration efficiency greater than 95% through a gas dehydration unit 54 to obtain dehydrated converter gas;

Decarbonising the dehydrated converter gas to a CO2 removal rate of greater than or equal to 95% through a gas decarbonisation unit 55 to obtain decarbonised converter gas.

Optionally, gas pressurisation unit 51, gas deoxygenation unit 53, gas dehydration unit 54, and gas decarbonisation unit 55 are connected in sequence. Further, gas pressurisation unit 51 is connected to the converter gas collection unit 4.

With reference to FIGS. 1, 2, 7 to 10, in some embodiments, the CO content in the untreated converter gas is greater than or equal to 40%, i.e., the carbon monoxide content in the converter gas discharged from the converter gas collection unit 4 to the gas pressurisation unit 51 is greater than or equal to 40%. In such cases, the untreated converter gas can undergo pressurisation, deoxygenation, dehydration, and decarbonisation sequentially to obtain treated converter gas.

With reference to FIGS. 3 to 6, in some embodiments, the process for obtaining treated converter gas from untreated converter gas includes additional steps of desulphurisation and denitrification, where desulphurisation precedes denitrification.

Optionally, pressurisation, desulphurisation, deoxygenation, dehydration, decarbonisation, and denitrification of the converter gas are carried out in sequence. Optionally, for desulphurisation and denitrification of the untreated converter gas:

Desulphurising the pressurised converter gas to a sulphur content less than 10 ppm through a desulphurisation unit 52 to obtain desulphurised converter gas, where the sulphur content can range from 0.1 ppm to 10 ppm;

Denitrifying the decarbonised converter gas to a denitrification efficiency greater than or equal to 90% through a denitrification unit 56 to obtain denitrified converter gas.

Further, gas pressurisation unit 51, gas desulphurisation unit 52, gas deoxygenation unit 53, gas dehydration unit 54, gas decarbonisation unit 55, and gas denitrification unit are connected in sequence. Optionally, prior to desulphurisation, the temperature of the pressurised converter gas is controlled at 60° C.~90° C. through a cooling unit, which can be installed on gas pressurisation unit 51 to adjust the cooling capacity of the outlet end of the gas pressurisation unit 51.

With reference to FIGS. 3 to 6, in some embodiments, untreated converter gas undergoes pressurisation, desulphurisation, deoxygenation, dehydration, decarbonisation, and denitrification sequentially to obtain treated converter gas.

With reference to FIGS. 1 to 12, in some embodiments, the treated converter gas is recycled back into the blast furnace 1 to adjust the proportion of reducing gases within the furnace, including:

Heating the treated converter gas to 850° C.~950° C. through a gas heating unit 6 to obtain heated converter gas;

Injecting the heated converter gas back into blast furnace 1 through a gas injection unit 3, where the injection nozzle of the gas injection unit 3 is aimed at the furnace body 11 and/or tuyere 12 of the blast furnace 1.

Optionally, a gas heating unit 6 can be installed or not installed as needed. When installed, the heat required for the gas heating unit 6 is provided by burning the gas in gas pipeline network 7, which includes blast furnace gas and/or syngas from blast furnace 1.

Further, gas pipeline network 7 is connected to blast furnace 1 and gas heating unit 6 for collecting blast furnace gas from blast furnace 1 and providing heat through combustion for gas heating unit 6. Optionally, when denitrification is not performed, gas pipeline network 7 is connected to the gas decarbonisation unit for collecting syngas from the treated converter gas. Optionally, when denitrification is performed, gas pipeline network 7 is connected to the gas nitrogen decarbonisation unit for collecting syngas from the treated converter gas.

With reference to FIGS. 1 to 10, in some embodiments, decarbonisation treatment can either be dry decarbonisation or wet decarbonisation. When the decarbonisation treatment is dry decarbonisation, the CO2 concentration in the synthesis gas is less than or equal to 95%, and the synthesis gas is fed into the gas pipeline network (7) connected to the blast furnace (1). When the decarbonisation treatment is wet decarbonisation, the CO2 concentration in the synthesis gas is greater than 95%, and the synthesis gas undergoes CCUS (Carbon Capture, Utilisation and Storage) treatment.

Optionally, when the synthesis gas undergoes CCUS treatment, it can be processed through a CCUS device connected to the decarbonisation device (55).

Below, as an example, a 2850 $m^3$ blast furnace is used. Through simulation calculations of the physical equilibrium and thermal equilibrium of the blast furnace, and in conjunction with different embodiments, further explanation of the present invention is provided.

Tables 1 to 4 show the original fuel conditions for the blast furnace and the conventional parameters for the blast furnace iron smelting process.

TABLE 1

| Ore Feed Grade in Blast Furnace | | | |
|---|---|---|---|
| FeO | $Fe_2O_3$ | TFe | 其它 |
| 5.5% | 77.28% | 58.38% | 17.21% |

TABLE 2

| Composition of Pulverised Coal Injected into the Blast Furnace | | | | | | | |
|---|---|---|---|---|---|---|---|
| Fixed | | Volatile | Volatile Matter Composition | | | | |
| Carbon | Ash | Matter | $CH_4$ | $C_2H_6$ | $N_2$ | $H_2$ | CO |
| 66% | 10.24% | 23.63% | 75.0% | 21.0% | 2.0% | 0.0% | 2.0% |

TABLE 3

| Average Composition of Converter Gas Dry Gas Composition | | | | | |
|---|---|---|---|---|---|
| | CO | $CO_2$ | $H_2$ | $N_2$ | $O_2$ |
| Average % | 44.2 | 27.7 | 1.5% | 28.6% | 0.3% |
| Fluctuation Range % | 40~60 | 11.1~30 | 0~4.1 | 14.9~30 | 0~0.4 |

TABLE 4

| Main Technical Indices for Conventional Blast Furnace | |
|---|---|
| Parameter | Conventional Blast Furnace |
| Coke-to-hot metal ratio, kg/thm | 355 |
| Coal-to-hot metal ratio, kg/thm | 160 |
| Fuel-to-hot metal ratio, kg/thm | 515 |
| Proportion of reductive gases in the furnace belly | 46% |
| Wind temperature, ° C. | 1250 |
| Wind pressure, Mpa: 0.5 | 0.5 |
| Blast oxygen enrichment | 5% |
| Theoretical combustion temperature, ° C. | 2026 |

Embodiment 1

Figure 2:
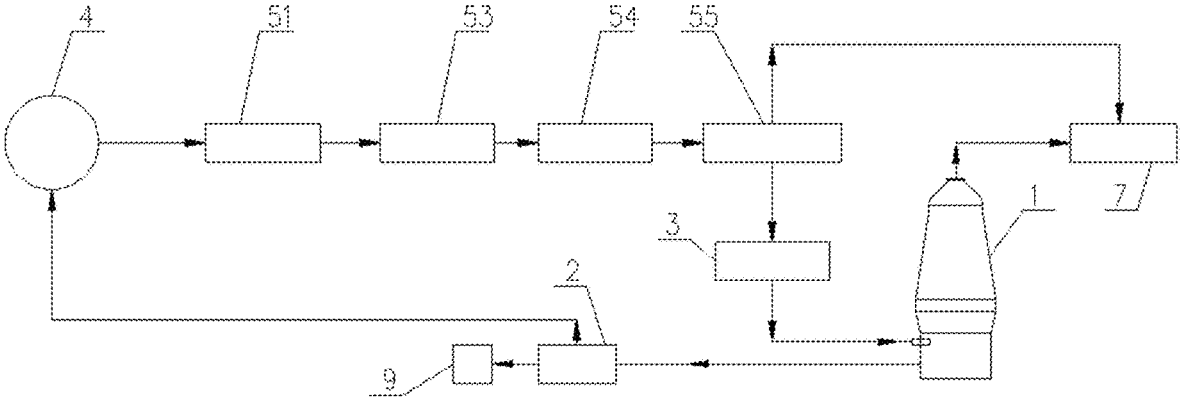
FIG. 2 is a schematic diagram of the production system used for implementing Embodiment 1.

This embodiment employs dry decarbonisation of converter gas, without denitrogenation or heating. As shown in FIGS. 1 and 2, the carbon-cycle-based blast furnace-converter steel production system in this embodiment includes, but is not limited to: converter gas collection device 4, gas pressurisation unit 51, gas deoxygenation unit 53, gas dehydration unit 54, gas decarbonisation unit 55, gas injection device 3, blast furnace 1, gas piping network 7, and converter 2. Among them, the blast furnace 1, gas piping network 7, and converter 2 are consistent with a conventional blast furnace-converter system. The specific details are explained in conjunction with Tables 1 to 3 concerning the raw fuel conditions of the conventional blast furnace.

The hot molten iron produced by blast furnace 1 is conveyed to converter 2 for decarbonisation, dephosphorisation, desulphurisation, and deoxygenation processes to obtain qualified molten steel 9. Converter 2 is a periodic steelmaking device with a typical smelting cycle of 25-45 minutes and requires oxygen blowing for decarbonisation. Hence, varying CO-containing converter gas is intermittently generated during the steelmaking process. When the CO content in the converter gas is greater than or equal to 40%, it is directed into the converter gas collection device 4 for storage and utilised in downstream processes.

In this embodiment, the converter gas collection device 4 can be a converter gas cabinet. Approximately 77,000 $Nm^3/h$ of converter gas with a CO content of ≥40% is drawn from the converter gas cabinet. The specific composition of the converter gas is shown in Table 3, with CO at 44.2%, CO2 at 27.7%, H2 at 1.5%, and N2 at 28.6%. The extracted converter gas is pressurised to 0.50-0.65 MPa by the gas pressurisation unit 51 to satisfy the subsequent decarbonisation treatment in the gas decarbonisation unit 55 and to enable the gas injection device 3 to inject the converter gas properly into the blast furnace 1.

As shown in Table 3, the converter gas also contains a certain proportion of oxygen, typically ranging from 0 to 0.4%. Considering that the molecular sieves in gas decarbonisation unit 55 are oxygen-sensitive and that there is a risk of gas explosion during compression and heating, the gas is deoxygenated using gas deoxygenation unit 53, reducing the oxygen content to <1 ppm.

After deoxygenation, the converter gas is dehydrated by the gas dehydration unit 54 and then enters the gas decarbonisation unit 55 for decarbonisation treatment. The decarbonisation can be done using dry decarbonisation technology. The volume of decarbonised converter gas is about 52,000 $Nm^3/h$, and the generated off-gas volume is approximately 25,000 $Nm^3/h$. The composition of the decarbonised gas and off-gas is shown in Table 5.

TABLE 5

Composition of Decarbonised Converter Gas and Off-Gas

| Component | CO | $CO_2$ | $H_2$ | $N_2$ |
|---|---|---|---|---|
| Decarbonised and denitrogenised converter gas V % | 59 | 1 | 1 | 39 |
| Off-Gas V % | 13.7 | 83.8 | 2.5 | 0 |

After dry decarbonisation in gas decarbonisation unit 55, the resulting off-gas still contains about 14% CO, which cannot be directly released or undergo CCUS (Carbon Capture, Utilisation, and Storage) treatment. The produced off-gas is directly channelled into the gas piping network 7 for use as fuel.

The pressurised and decarbonised converter gas is directly injected into blast furnace 1 in a cold state through gas injection device 3. This substantially increases the proportion of reducing gases in the furnace belly gas of blast furnace 1. The composition of the furnace belly gas is shown in Table 6, thereby promoting indirect reduction, reducing direct reduction, and consequently lowering the fuel consumption per tonne of iron and CO2 emissions in blast furnace 1.

TABLE 6

Composition of Blast Furnace Gas

| Content | CO | $H_2$ | $N_2$ |
|---|---|---|---|
| Percentage | 45% | 7.3% | 47.7% |

Based on heat balance and material balance calculations in the blast furnace, after injecting decarbonised converter gas back into blast furnace 1, the fuel ratio is 463 kg/t, comprising 150 kg/t of coal and 313 kg/t of coke. Compared to a conventional blast furnace, the carbon-containing fuel is significantly reduced, resulting in a 52 kg/t reduction in the fuel ratio and a direct carbon reduction proportion of 10%. This equates to a reduction of approximately 165 kg/t CO2 emissions per tonne of iron. The specific indices are shown in Table 7.

TABLE 7

Main Technical Indicators of Implementation Example 1

| Parameter | Conventional Blast Furnace | Example 1: Converter Gas Decarbonisation, No Denitrogenation, Unheated |
|---|---|---|
| Coke Ratio, kg/thm | 355 | 313 |
| Coal Ratio, kg/thm | 160 | 150 |
| Fuel Ratio, kg/thm | 515 | 463 |
| Belly Gas Reducing Gas Proportion | 46% | 50% |
| Blast Oxygen Enrichment Rate | 5% | 9.5% |
| Carbon Reduction Percentage | | 10% |

After steelmaking in converter 2, the resulting molten steel is used in subsequent processes. The byproduct, converter gas, is collected in converter gas collection device 4 for recycling. This cyclical utilisation of converter gas enables more efficient blast furnace smelting and reduces CO2 emissions.

Embodiment 2

Figure 3:
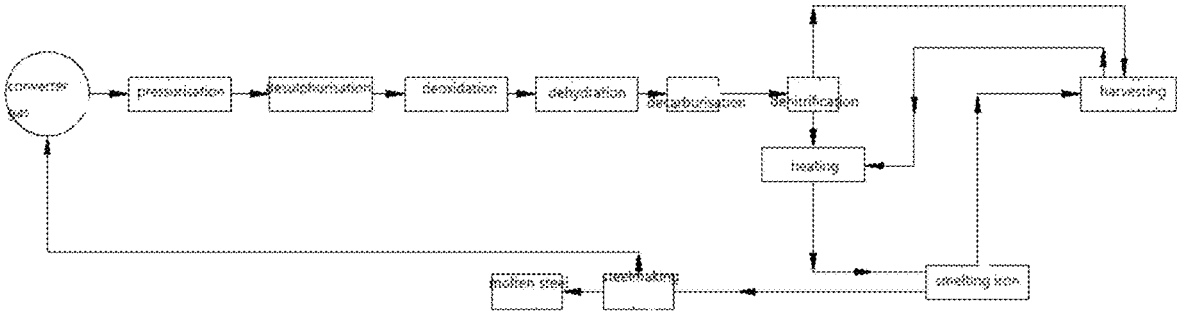
FIG. 3 is a schematic flow diagram of Embodiment 2 of the carbon-cycling-based method for steel production via a blast furnace and coke oven, as provided by this application.
Figure 4:
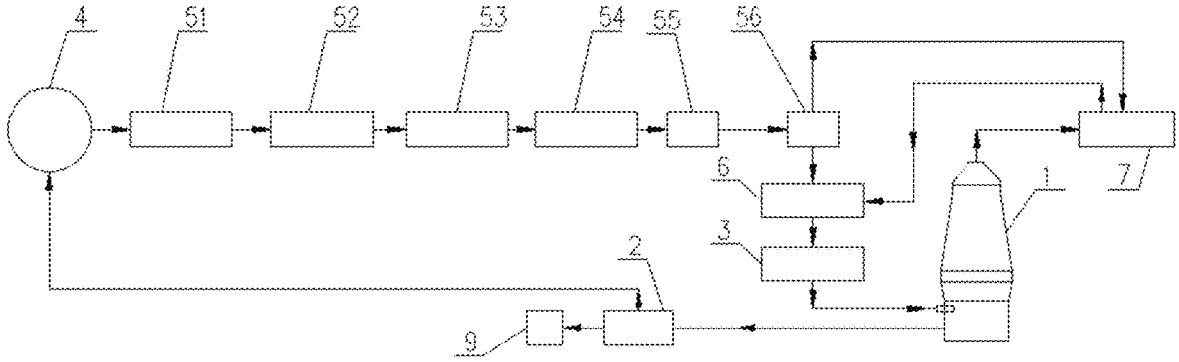
FIG. 4 is a schematic diagram of the production system used for implementing Embodiment 2.

Embodiment 2: This embodiment utilises a dry method for carbon removal from converter gas, in addition to nitrogen removal and heating. Refer to FIGS. 3 and 4; the carbon-cycling-based blast furnace-converter iron and steel production system in this embodiment includes, but is not limited to: converter gas collection device 4, gas pressurisation unit 51, gas desulphurisation unit 52, gas deoxygenation unit 53, gas dehydration unit 54, gas decarbonisation unit 55, gas denitrogenation unit 56, gas heating unit 6, gas injection unit 3, blast furnace 1, gas pipeline network 7, and converter 2. Among these, the blast furnace 1, gas pipeline network 7, and converter 2 are consistent with a conventional blast furnace-converter system.

In this embodiment, the converter gas collection device 4 can be a converter gas cabinet. The difference between this embodiment and Embodiment 1 lies in the addition of a gas desulphurisation unit 52, a gas denitrogenation unit 56, a gas heating unit 6, and a cooling device configured in the gas pressurisation unit 51. All other systems and treatment methods, as well as the initial fuel conditions, are entirely consistent with Embodiment 1; only the differences are described.

In this embodiment, the cooling capacity at the outlet end of the gas pressurisation unit 51 is adjusted by the cooling device to ensure that the exit temperature of the pressurised converter gas falls within the range of 60° C. to 90° C., to meet desulphurisation requirements. Normally, converter gas contains between 15% and 30% nitrogen. To increase the proportion of reducing gas entering blast furnace 1 and enhance decarbonisation effectiveness, nitrogen removal can be performed via the gas denitrogenation unit 56, thus reducing the N2 content entering the furnace. Given that converter gas contains 20-30 ppm of sulphur and that the denitrogenation process requires stringent sulphur content control to prevent poisoning of the denitrogenation adsorbent, it is necessary to employ the gas desulphurisation unit 52 for sulphur removal. The converter gas temperature is controlled at 60° C. to 90° C., and the post-treatment sulphur content must be less than 10 ppm; for example, it can range between 0.1 ppm and 10 ppm.

In this embodiment, the converter gas sequentially undergoes pressurisation, desulphurisation, deoxygenation, dehydration, decarbonisation, and denitrogenation before receiving heat treatment. The volume of the decarbonised and denitrogenated converter gas is approximately 35,000 $Nm^3/h$, and the volume of generated analytical gas is approximately 42,000 $Nm^3/h$. The composition of the gas is indicated in Table 8.

TABLE 8

Composition of Converter Gas and Analytical Gas After Decarbonisation and Denitrogenation

| Composition | CO | $CO_2$ | $H_2$ | $N_2$ |
|---|---|---|---|---|
| Decarbonised and Denitrified Converter Gas V % | 88 | 1 | 1 | 10 |
| Off-Gas V % | 8 | 50 | 2 | 40 |

After adopting the dry decarbonisation process, the off-gas produced still contains about 8% of CO, which cannot be directly discharged or subjected to CCUS (Carbon Capture, Utilisation, and Storage) treatment. The off-gas is piped directly into the blast furnace gas network 7 for use as fuel.

After decarbonisation and denitrogenation, the converter off-gas is heated to 850° C.~950° C. by the gas heating apparatus 6 to supplement heat when the converter gas is blown back into blast furnace 1. The heat required for the gas heating apparatus 6 is provided by the combustion of blast furnace gas in the gas network 7.

After pressurisation, decarbonisation, denitrogenation, and heating, the converter off-gas is sprayed into blast furnace 1 through the gas injection apparatus 3. This substantially increases the proportion of reducing gases in the belly gas of blast furnace 1. The composition of the belly gas is shown in Table 9. This promotes indirect reduction in the blast furnace, reducing the direct reduction, thereby reducing the fuel consumption per tonne of iron smelted in blast furnace 1 and lowering the CO2 emissions during the iron smelting process in the blast furnace.

TABLE 9

Composition of Blast Furnace Gas

| Composition | CO | $H_2$ | $N_2$ |
|---|---|---|---|
| Percentage | 42.4% | 8.6% | 49% |

After calculations of thermal balance and material balance in the blast furnace, when the decarbonised, denitrogenated, and heated converter off-gas is blown back into blast furnace 1, the fuel ratio is 433 kg/t, of which the coal ratio is 180 kg/t and the coke ratio is 253 kg/t. Compared to a conventional blast furnace, the carbon-containing fuel is significantly reduced; the fuel ratio is lowered by 82 kg/t, direct carbon reduction is at 16%, and CO2 emissions are reduced by approximately 256 kg per tonne of iron. The specific indices are shown in Table 10.

TABLE 10

Main Technical Indices of Embodiment 2

| Parameter | Conventional Blast Furnace | Embodiment 2: Converter gas decarbonisation, denitrogenation, and heating |
|---|---|---|
| Coke Ratio, kg/thm | 355 | 253 |
| Coal Ratio, kg/thm | 160 | 180 |
| Fuel Ratio, kg/thm | 515 | 433 |
| Belly Gas Reducing Gas Proportion | 46% | 51% |
| Wind Temperature, ° C. | 1250 | 1250 |
| Wind Pressure, Mpa | 0.5 | 0.5 |
| Blast Furnace Oxygen Enrichment Rate | 5% | 6% |
| Theoretical Combustion Temperature, ° C. | 2026 | 2078 |

Embodiment 3

Figure 5:
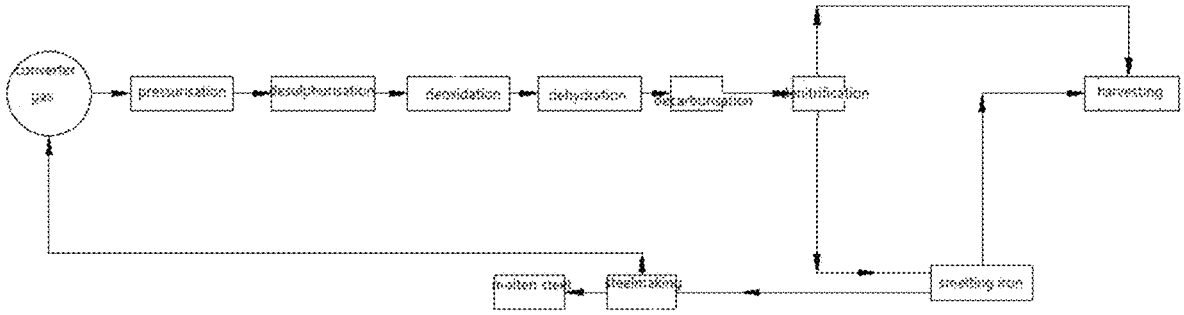
FIG. 5 is a schematic flow diagram of Embodiment 3 of the carbon-cycling-based method for steel production via a blast furnace and coke oven, as provided by this application.
Figure 6:
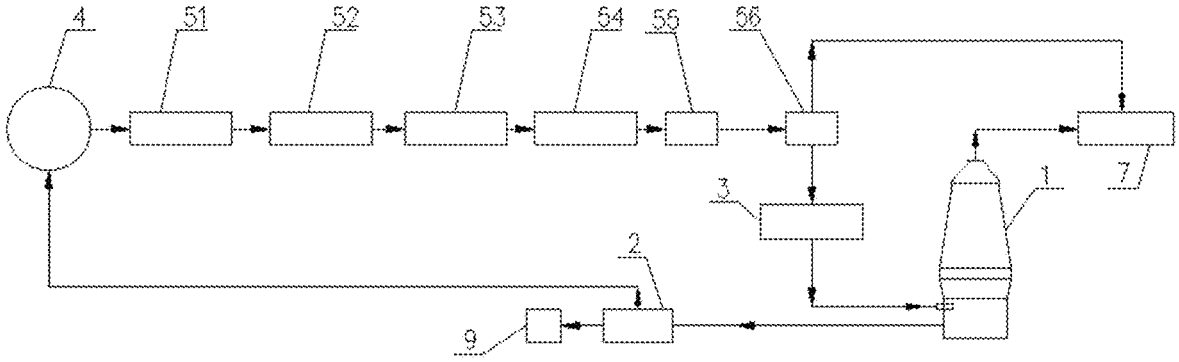
FIG. 6 is a schematic diagram of the production system used for implementing Embodiment 3.

This embodiment adopts a dry method of decarbonisation and denitrogenation of converter gas without heating. Refer to FIGS. 5 and 6; the carbon-cycling blast furnace-converter steel production system implemented in this embodiment includes but is not limited to: converter gas collection device 4, gas pressurisation device 51, gas desulphurisation device 52, gas deoxygenation device 53, gas dehydration device 54, gas decarbonisation device 55, gas denitrogenation device 56, gas injection device 3, blast furnace 1, gas pipeline network 7, and converter 2. Among them, blast furnace 1, gas pipeline network 7, and converter 2 are consistent with the conventional blast furnace-converter system. The difference from Embodiment 2 is that after decarbonisation and denitrogenation, the converter gas is not heated, and cold gas is directly injected into blast furnace 1. Other systems and treatment methods, as well as original fuel conditions, are completely consistent with Embodiment 2 and are not repeated here; only the differences are described.

After pressurisation, decarbonisation, and denitrogenation, the converter gas is injected into blast furnace 1 through the gas injection device 3 from the blast furnace tuyere. This can significantly increase the proportion of reducing gas in the furnace belly gas of blast furnace 1. The composition of the furnace belly gas is shown in Table 11, thereby promoting indirect reduction in the blast furnace, reducing direct reduction, reducing fuel consumption per tonne of iron smelted in blast furnace 1, and reducing CO2 emissions during the blast furnace ironmaking process.

TABLE 11

| Composition of Furnace Belly Gas | | | |
|---|---|---|---|
| Composition | CO | $H_2$ | $N_2$ |
| Percentage | 43.1% | 7.3% | 49.6% |

Following the heat balance and material balance calculations of the blast furnace, after the decarbonisation, denitrogenation, and heating of the converter gas which is then injected back into Blast Furnace 1, the fuel ratio stands at 447 kg/t, with coal accounting for 150 kg/t and coke 297 kg/t. Compared to the conventional blast furnace, there's a noticeable reduction in carbon-containing fuel, a decrease in the fuel ratio by 68 kg/t, a direct carbon reduction of approximately 13%, and a reduction in CO2 emissions of about 213 kg/t per tonne of iron.

Embodiment 4

Figure 7:
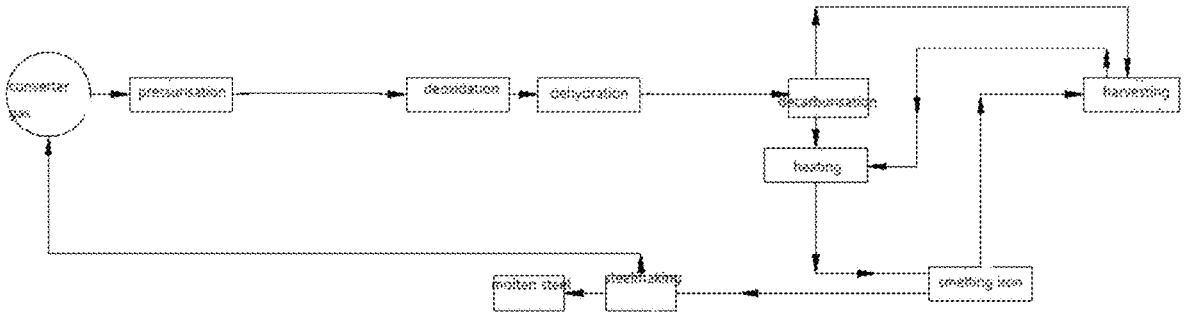
FIG. 7 is a schematic flow diagram of Embodiment 4 of the carbon-cycling-based method for steel production via a blast furnace and coke oven, as provided by this application.
Figure 8:
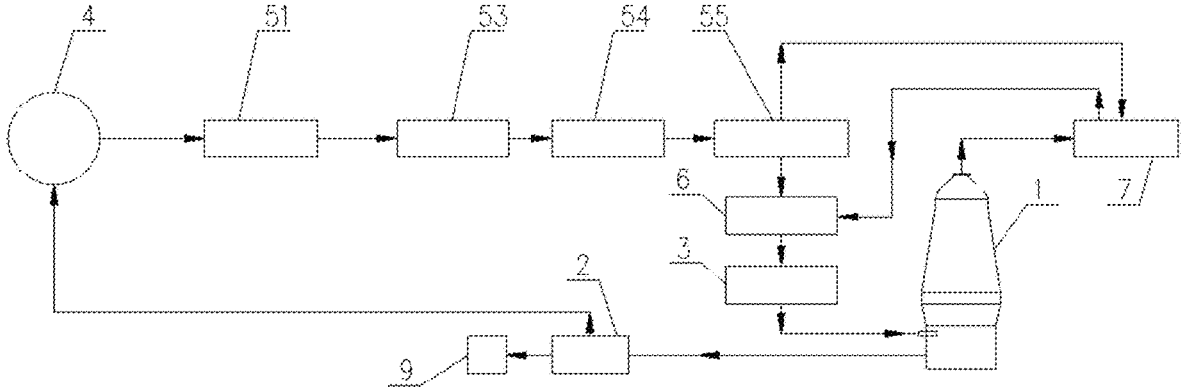
FIG. 8 is a schematic diagram of the production system used for implementing Embodiment 4.

This embodiment utilises a dry method of decarbonising the converter gas, without denitrogenation, and includes heating. Refer to FIGS. 7 and 8. The carbon-cycling blast furnace-converter steel production system in this embodiment includes, but is not limited to: converter gas collection device 4, gas pressurisation device 51, gas deoxygenation device 53, gas dehydration device 54, gas decarbonisation device 55, gas heating device 6, gas injection device 3, blast furnace 1, gas pipeline network 7, and converter 2. Among them, blast furnace 1, gas pipeline network 7, and converter 2 are consistent with the conventional blast furnace-converter system. The difference from Embodiment 2 is the omission of gas desulphurisation and gas denitrogenation processes. After decarbonisation, the converter gas is heated by the gas heating device 6 and then injected into blast furnace 1 through the gas injection device 3. Other systems, treatment methods, and original fuel conditions are consistent with Embodiment 2, so they are not repeated here; only the differences are described.

Since the converter gas does not undergo denitrogenation, the gas desulphurisation device is eliminated. After the converter gas undergoes pressurisation, deoxygenation, and dehydration, it enters the gas decarbonisation device 55 for gas decarbonisation treatment, still using the dry decarbonisation process. The volume of converter gas after decarbonisation is approximately 52,000 Nm^3/h, with the resultant off-gas volume being about 25,000 Nm^3/h. The composition of the decarbonised gas and off-gas is shown in Table 12.

TABLE 12

| Composition of Decarbonised Converter Gas and Off-gas | | | | |
|---|---|---|---|---|
| Composition | CO | $CO_2$ | $H_2$ | $N_2$ |
| Converter gas after denitrogenation and decarbonisation, V % | 59 | 1 | 1 | 39 |
| Off-Gas V % | 13.7 | 83.8 | 2.5 | 0 |

After the dry decarbonisation process in the gas decarbonisation device 55, the resultant off-gas still contains about 14% CO. It cannot be directly released or subjected to CCUS treatment. The produced off-gas is directly channelled into the gas pipeline network 7 via pipes and is used as fuel.

After pressurisation and decarbonisation, the converter gas is directly injected in its cold state into Blast Furnace 1 through the gas injection device 3 from the blast furnace tuyere. This can significantly increase the proportion of reducing gas in the furnace belly gas of Blast Furnace 1. The composition of the furnace belly gas is shown in Table 13. This promotes indirect reduction in the blast furnace, decreases direct reduction, reduces the fuel consumption per tonne of iron smelted in Blast Furnace 1, and reduces CO2 emissions during the blast furnace ironmaking process.

TABLE 13

| Composition of Furnace Belly Gas | | | |
|---|---|---|---|
| Composition | CO | $H_2$ | $N_2$ |
| Percentage | 42.8% | 7.7% | 49.5% |

Following the heat balance and material balance calculations of the blast furnace, after the decarbonisation, denitrogenation, and heating of the converter gas which is then injected back into Blast Furnace 1, the fuel ratio stands at 449 kg/t, with coal accounting for 160 kg/t and coke 289 kg/t. Compared to the conventional blast furnace, there's a noticeable reduction in carbon-containing fuel, a decrease in the fuel ratio by 66 kg/t, a direct carbon reduction of 12.8%, and a reduction in CO2 emissions of about 206 kg/t per tonne of iron. For specifics, please refer to Table 14.

TABLE 14

| Comparison of Main Technical Indicators for Embodiments 1 to 4 | | | | | |
|---|---|---|---|---|---|
| Parameter | Conventional Blast Furnance | Embodiment 1: Decarbonisation, without denitrogenation, no heating | Embodiment 2: Decarbonisation, denitrogenation, heating | Embodiment 3: Decarbonisation, denitrogenation, no heating | Embodiment 4: Decarbonisation, without denitrogenation, heating |
| Coke ratio, kg/t | 355 | 313 | 253 | 297 | 289 |
| Coal ratio, kg/t | 160 | 150 | 180 | 150 | 160 |
| Fuel ratio, kg/t | 515 | 463 | 433 | 447 | 449 |
| Furnace belly gas reducing gas proportion | 46% | 50% | 51% | 50% | 50% |

TABLE 14-continued

Comparison of Main Technical Indicators for Embodiments 1 to 4

| Parameter | Conventional Blast Furnance | Embodiment 1: Decarbonisation, without denitrogenation, no heating | Embodiment 2: Decarbonisation, denitrogenation, heating | Embodiment 3: Decarbonisation, denitrogenation, no heating | Embodiment 4: Decarbonisation, without denitrogenation, heating |
|---|---|---|---|---|---|
| Blast oxygen enrichment rate | 5% | 9.5% | 6% | 6% | 7.5% |
| Carbon reduction ratio | | 10% | 16% | 13% | 12.8% |

Embodiment 5

Figure 9:
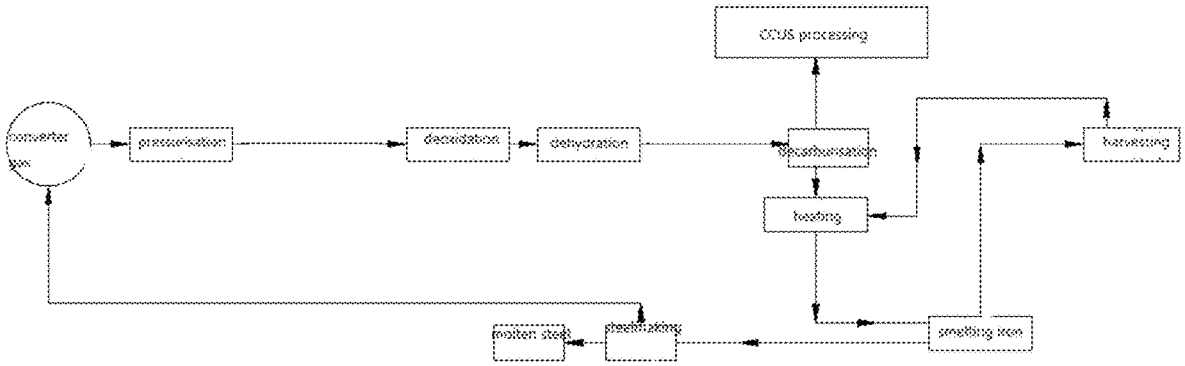
FIG. 9 is a schematic flow diagram of Embodiment 5 of the carbon-cycling-based method for steel production via a blast furnace and coke oven, as provided by this application.
Figure 10:
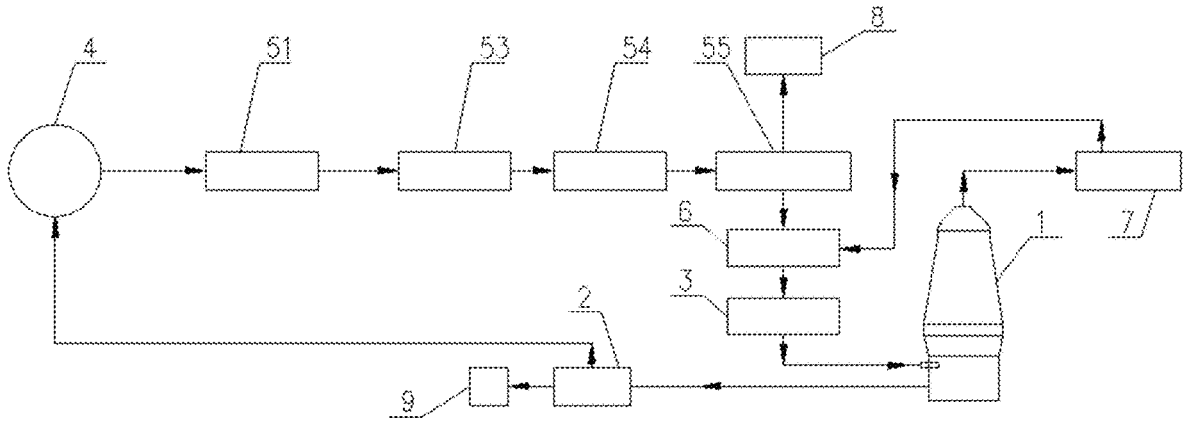
FIG. 10 is a schematic diagram of the production system used for implementing Embodiment 5.

This embodiment employs the wet method of decarbonisation for converter gas, without denitrogenation, and incorporates heating. As depicted in FIGS. 9 and 10, the system for this embodiment is based on carbon cycling within the blast furnace-converter steel production. It comprises, but is not limited to: a converter gas collection device 4, a gas pressurisation apparatus 51, a gas dehydration unit 54, a gas decarbonisation device 55, a CCUS unit 8, a gas heating device 6, a gas injection apparatus 3, a blast furnace 1, a gas pipeline network 7, and a converter 2. The blast furnace 1, gas pipeline network 7, and converter 2 adhere to the conventional standards of the blast furnace-converter systems. Contrasting with Embodiment 2, the converter gas does not undergo desulphurisation or denitrogenation. The gas decarbonisation uses the wet method, resulting in the analytical gas having a higher CO2 purity. This can be directly fed into the CCUS unit 8 or directly discharged, and no longer channelled into the gas pipeline network 7. After decarbonisation, the gas is heated by the gas heating device 6 and then injected into the blast furnace 1 by the gas injection apparatus 3. The other systems, methods, and original fuel conditions are entirely consistent with Embodiment 2, and thus not reiterated here; only differences are described. The distinction between this embodiment and Embodiment 4 lies in the gas decarbonisation apparatus used. This embodiment adopts the wet method for decarbonisation, whereas Embodiment 3 utilises the dry method. The differences in decarbonisation effects are minimal, so the reactions within the blast furnace and the carbon reduction effects remain largely unchanged, and thus are not further elaborated upon here. Given that the converter gas does not undergo denitrogenation, the gas desulphurisation unit is omitted. The converter gas, after pressurisation, deoxygenation, and dehydration, enters the gas decarbonisation device 55 for treatment using the wet method. After decarbonisation, the volume of the converter gas is approximately 56,000 Nm3/h, producing an analytical gas volume of about 21,000 Nm3/h. The composition of the decarbonised gas and analytical gas can be found in Table 15.

TABLE 15

Composition of Decarbonised Converter Gas and Off-Gas

| Composition | CO | $CO_2$ | $H_2$ | $N_2$ |
|---|---|---|---|---|
| Converter Gas Composition After Nitrogen and Carbon Removal (V %) | 61 | 1 | 1.5 | 36.7 |
| Off-Gas V % | 0.8 | 99.2 | 0 | 0 |

The gas decarbonisation unit 55 adopts a wet carbon removal process, resulting in an off-gas with a very high CO2 concentration of over 99%, virtually free of CO. This can be directly processed using CCUS or directly discharged, without being fed back into the gas pipeline network 7.

Embodiment 6

Figure 11:
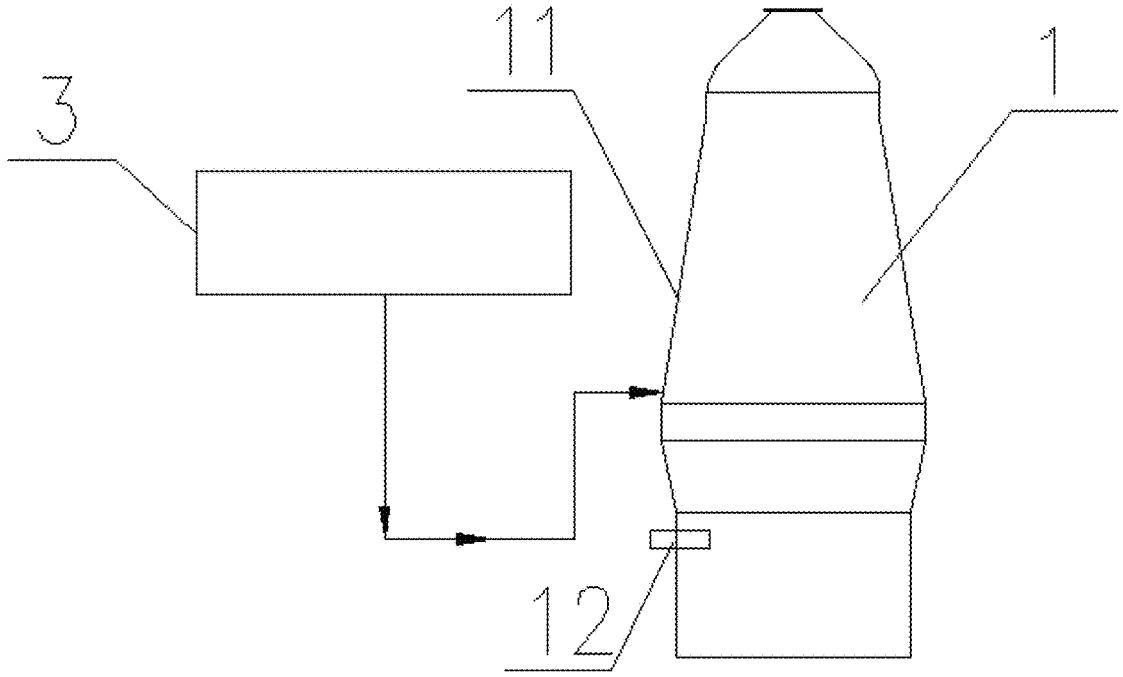
FIG. 11 is a schematic diagram of the structure for injecting gas from the gas injection unit into the body of the blast furnace.

Referring to FIG. 11, for the decarbonised converter gas in Embodiments 1 to 5, all are injected into the blast furnace 1 through the tuyere 12. Depending on different operational conditions and actual carbon reduction needs, the decarbonised converter gas can be injected from the body 11 of the blast furnace 1. The treatment of other systems remains the same as in Embodiments 1 to 5 and is not reiterated here.

Embodiment 7

Figure 12:
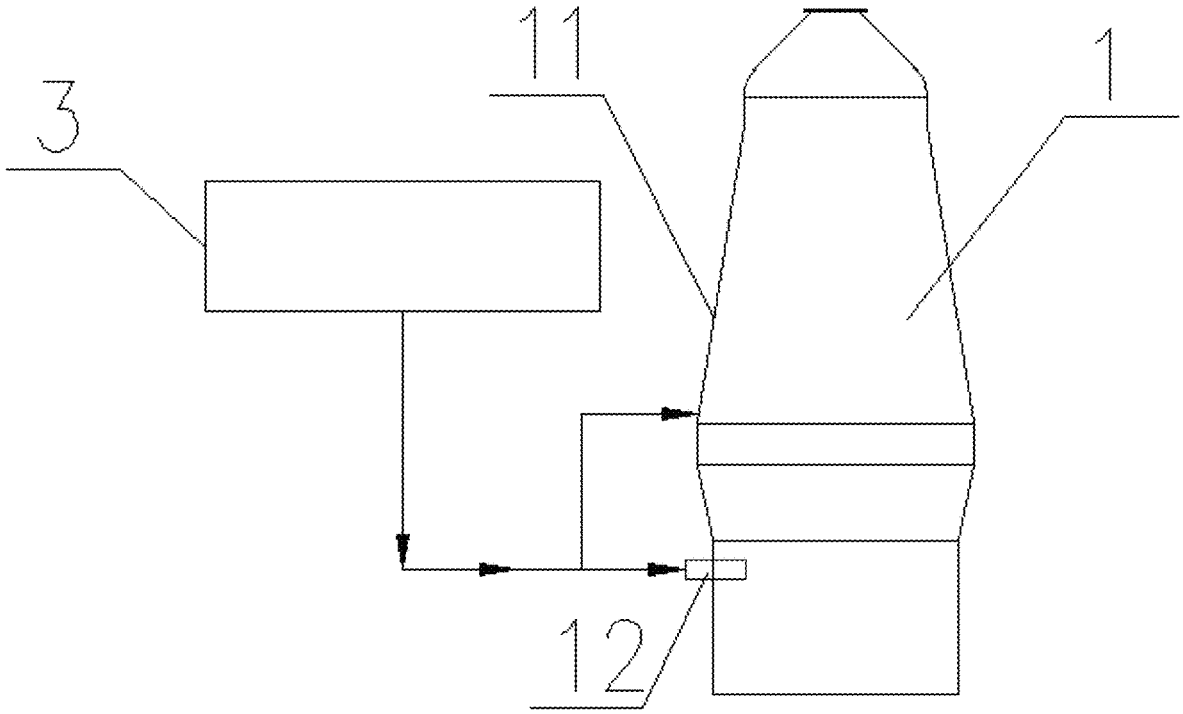
FIG. 12 is a schematic diagram of the structure for injecting gas from the gas injection unit into the body and tuyeres of the blast furnace.

Referring to FIG. 12, in the aforementioned Embodiments 1 to 5, the decarbonised converter gas is injected into the blast furnace 1 through the tuyere 12. Depending on different operational conditions and actual carbon reduction needs, the decarbonised converter gas can be injected both from the body 11 and the tuyere 12 of the blast furnace 1. The treatment of other systems remains the same as in Embodiments 1 to 5 and is not reiterated here.

The carbon cycle-based blast furnace-converter steel production method of this invention is simple in procedure and easy to operate. It utilises a carbon cycle-based blast furnace-converter steel production system to achieve pressurisation, desulphurisation, deoxygenation, dehydration, decarbonisation, and denitrification of the converter gas. By leveraging the converter gas produced during steelmaking, and after pressurisation, desulphurisation, deoxygenation, dehydration, decarbonisation, denitrification, and heating, it is recycled back into the blast furnace. This fully utilises the effective reducing gases in the converter gas, increasing the proportion of reducing gases in the belly of the blast furnace, promoting indirect reduction in the blast furnace, reducing the consumption of carbonaceous fuel in blast furnace ironmaking, thereby improving the utilisation efficiency of converter gas, effectively reducing CO2 emissions in the blast furnace-converter steel production process, making it more energy-efficient and environmentally friendly.

The aforementioned embodiments are only illustrative of the principles and effects of this invention and are not intended to limit the invention. Any person skilled in the art can modify or change the above embodiments without departing from the spirit and scope of this invention. Thus, any equivalent modifications or changes completed by those with ordinary knowledge in the technical field, without departing from the spirit and technical ideas disclosed by this invention, should still be covered by the claims of this invention.

The invention claimed is:

1. A method for steel production in a blast furnace and a converter based on carbon cycling, characterised by the following steps:

a) smelting iron in a blast furnace to obtain molten iron;

b) introducing said molten iron into a converter for steel refining to obtain molten steel and untreated converter gas;

c) subjecting the untreated converter gas to pressurisation, desulphurisation, deoxygenation, dehydration, decarbonisation, and denitrification sequentially to obtain synthesis gas and treated converter gas;

d) recycling the treated converter gas back into the blast furnace to regulate the ratio of reductive gases within the furnace atmosphere;

wherein the untreated converter gas contains a CO concentration of 40% or higher;

wherein step c) further comprises pressurising said untreated converter gas to 0.50 MPa~0.65 MPa via a gas pressurisation unit;

wherein in step c), prior to the desulphurisation process, the temperature of the pressurised converter gas is controlled between 60° C.~90° C. through a cooling unit;

wherein in step c), the desulphurisation and denitrification include reducing the sulphur content to less than 10 ppm through a desulphurisation unit, and achieving a denitrification efficiency of 90% or higher through a denitrification unit;

wherein in step c), the desulphurisation and denitrification include reducing the sulphur content to less than 10 ppm through a desulphurisation unit;

wherein in step c), the desulphurisation and denitrification include achieving a denitrification efficiency of 90% or higher through a denitrification unit;

wherein in step d), the recycling of treated converter gas back into the blast furnace includes heating the treated converter gas to 850° C.~950° C. through a gas heating unit; the heated converter gas is blown back into the blast furnace so that the fuel ratio is 433 kg/t.

2. The method according to claim 1, said method includes the pressurisation, deoxygenation, dehydration, and decarbonisation of untreated converter gas through:

c1) reducing the oxygen content to less than 1 ppm via a deoxygenation unit;

c2) achieving a dehydration efficiency greater than 95% via a dehydration unit;

c3) achieving a $CO_2$ removal rate of 95% or higher via a decarbonisation unit.

3. The method according to claim 1, the recycling of treated converter gas back into the blast furnace includes using a gas injection unit to direct the heated converter gas back into the blast furnace, where the injection nozzle is aimed at the furnace body and/or tuyeres.

4. The method according to claim 3, the heat required for gas heating is provided by the combustion of gas within the gas network, which includes blast furnace gas and/or synthesis gas.

5. The method according to claim 3, the decarbonisation treatment can be either dry or wet;

wherein when dry decarbonisation is used, the $CO_2$ concentration in the synthesis gas is ≤95%, and this synthesis gas is combined with the gas network connected to the blast furnace; and when wet decarbonisation is employed, the $CO_2$ concentration in the synthesis gas exceeds 95%, and the synthesis gas undergoes carbon capture utilization, and storage (CCUS) treatment.

* * * * *